US008253629B2

(12) United States Patent
Huang et al.

(10) Patent No.: US 8,253,629 B2
(45) Date of Patent: Aug. 28, 2012

(54) DIELECTRIC ROD ANTENNA AND METHOD FOR OPERATING THE ANTENNA

(75) Inventors: Kao-Cheng Huang, Kent (GB); Zhaocheng Wang, Stuttgart (DE); Vladimir Nikolajevic, Stuttgart (DE)

(73) Assignee: Sony Deutschland GmbH, Berlin (DE)

( * ) Notice: Subject to any disclaimer, the term of this patent is extended or adjusted under 35 U.S.C. 154(b) by 995 days.

(21) Appl. No.: 11/908,357

(22) PCT Filed: Dec. 19, 2005

(86) PCT No.: PCT/EP2005/013668

§ 371 (c)(1), (2), (4) Date: Oct. 1, 2008

(87) PCT Pub. No.: WO2006/097145

PCT Pub. Date: Sep. 21, 2006

(65) Prior Publication Data

US 2009/0231221 A1 Sep. 17, 2009

(30) Foreign Application Priority Data

Mar. 18, 2005 (EP) ..... 05005998

(51) Int. Cl.
*H01Q 5/00* (2006.01)

(52) U.S. Cl. ..... 343/700 MS; 343/785

(58) Field of Classification Search ..... 343/900, 343/785, 700 MS

See application file for complete search history.

(56) References Cited

U.S. PATENT DOCUMENTS

| | | | | |
|---|---|---|---|---|
| 2,624,002 | A * | 12/1952 | Bouix | 343/778 |
| 5,453,754 | A | 9/1995 | Fray | |
| 5,757,323 | A * | 5/1998 | Spencer | 343/700 MS |
| 6,462,700 | B1 * | 10/2002 | Schmidt et al. | 342/70 |
| 6,667,722 | B1 * | 12/2003 | Schmidt et al. | 343/785 |
| 6,714,166 | B2 * | 3/2004 | Sasaki et al. | 343/785 |
| 2004/0119646 | A1 | 6/2004 | Ohno et al. | |

FOREIGN PATENT DOCUMENTS

| | | |
|---|---|---|
| EP | 0 755 092 | 1/1997 |
| JP | 2-137405 | 5/1990 |
| JP | 2 137405 | 5/1990 |
| JP | 3 139903 | 6/1991 |
| JP | 2004-64246 | 2/2004 |
| JP | 2004-304659 | 10/2004 |

OTHER PUBLICATIONS

Yih Shiau, "Dielectric Rod antennas for Millimeter-Wave Integrated Circuits", IEEE Transactions on Microwave Theory and techniques, Nov. 1976, pp. 869-872.

Kobayashi, et al., "Dielectric Tapered Rod Antennas for Millimeter-Wave Applications", IEEE Transactions on Antennas and Propagation, vol. AP-30, No. 1, pp. 54-58, XP002346425, 1982.

Office Action issued Sep. 14, 2010 in JP Application No. 2008-501172 (English Translation).

Office Action issued May 10, 2011 in Japanese Patent Application No. 2008-501172 (English translation only).

* cited by examiner

*Primary Examiner* — Jacob Y Choi
*Assistant Examiner* — Kyana R McCain
(74) *Attorney, Agent, or Firm* — Oblon, Spivak, McClelland, Maier & Neustadt, L.L.P.

(57) ABSTRACT

A rod antenna and a method for operating the rod antenna. The rod antenna includes a two-dimensional patch for radiating and/or receiving an electromagnetic wave, the patch extending along a plane defined by two coordinate axes orthogonal to each other. A feeding line is coupled to the patch for transferring signal energy to and/or from the patch, and a dielectric rod radiates and/or receives the electromagnetic wave, the rod extending longitudinally from the patch in direction of a third coordinate axis outside of the plane defined by the first two coordinate axes. A metal holder is coupled to the patch and to the rod for transferring the electromagnetic wave between the patch and the rod.

11 Claims, 4 Drawing Sheets

DIELECTRIC ROD ANTENNA AND METHOD FOR OPERATING THE ANTENNA

Figure 1:
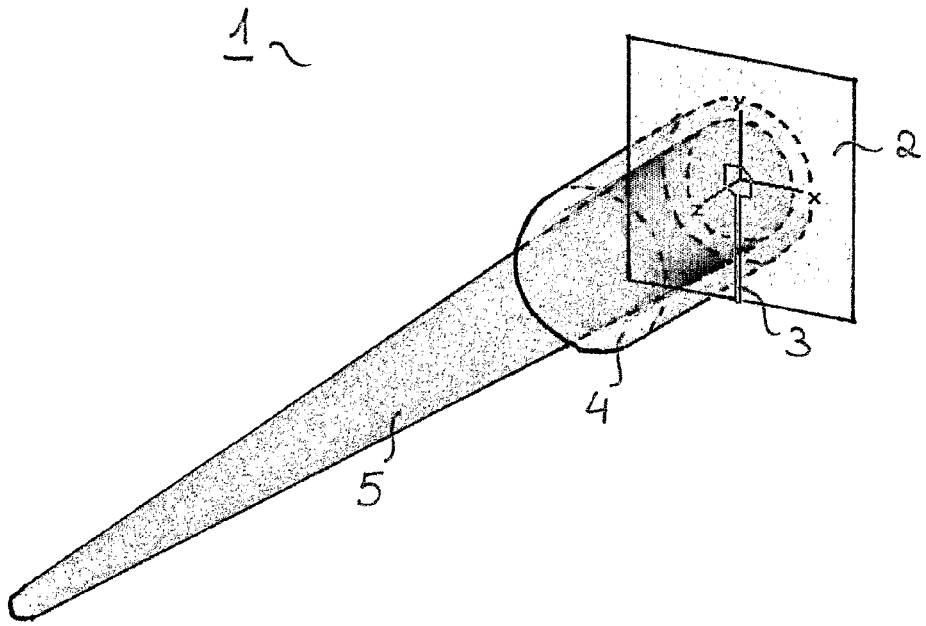

The present invention relates to a rod antenna and to a method for operating a rod antenna.

In the recent past, the requirements for an antenna have significantly increased. There is the need to have antenna systems which can be flexibly adapted to the requirements of different applications. Further, it is preferred to have a radiation pattern with a small size, small sidelobe, a high directivity, a high gain, integration capability with planar circuitry and an antenna which in addition is cost-effective.

From the state of art rod antennas are known where the feedings is realised by a three-dimensional wave guide feeding. For example, the document Kobayashi et al. "Dielectric Tapered Rod Antennas For Milimeter-Wave Applications", IEEE Transactions on Antennas and Propagation, January 1982, discloses the feeding of dielectric rod antennas by a metal waveguide, whereby the waveguide is matched by a launching horn. The problem that arises with a rod antenna according to the state of art is that with the waveguide feeding the antenna cannot be flexibly adapted to different requirements.

The object of the present invention is therefore to provide a rod antenna that can be easily implemented and adapted to the requirements of different applications such as planar circuitry.

The above-mentioned object is achieved by a rod antenna.

The rod antenna according to the present invention comprises a two-dimensional patch for radiating and/or receiving an electromagnetic wave, said patch extending along a plane defined by two coordinate axes being orthogonal to each other, a feeding line coupled to the patch for transferring signal energy to and/or from the patch, a dielectric rod for radiating and/or receiving said electromagnetic wave, said rod extending longitudinally from the patch in direction of a third coordinate axis being outside of the plane defined by the first two coordinate axes and a metal holder coupled to the patch and to the rod for transferring said electromagnetic wave between the patch and the rod.

The above-mentioned object is further achieved by a method for operating a rod antenna.

The method according to the present invention comprises the steps of radiating and/or receiving an electromagnetic wave by a two-dimensional patch, said patch extending along a plane defined by two coordinate axes being orthogonal to each other, transferring signal energy to and/or from the patch by a feeding line coupled to the patch, radiating and/or receiving said electromagnetic wave by a dielectric rod, said rod extending longitudinally from the patch in direction of a third coordinate axis being outside of the plane defined by the first two coordinate axes and transferring said electromagnetic wave between the patch and the rod by a metal holder coupled to the patch and to the rod.

Preferably, the feeding line is extending along one of the first two coordinate axes or is orthogonal to the first two coordinate axes.

Further preferably, the length of the metal holder is equal to the wavelength of the said electromagnetic wave.

In one embodiment the length of the metal holder is equal to a half of the wavelength of said electromagnetic wave.

The rod may be extending into a direction being orthogonal to the plane defined by the first two coordinate axes.

Advantageously the rod has an oval, elliptical, circular or rectangular cross section.

The rod may have a cross section constant in size and shape over the whole length of the rod.

The rod may be tapering toward one end.

Preferably the rod has a top plane.

The normalised direction of the top plane may be extending in direction of the third coordinate axis.

The normalised direction of the top plane may be extending into a direction different from the direction of third coordinate axis.

Preferably an antenna array comprises at least two groups of at least one rod antenna according to any of the preceding claims, whereby the rod antennas of a group have a beaming direction different than the beaming direction of the rod antennas of the other groups.

Figure 2:
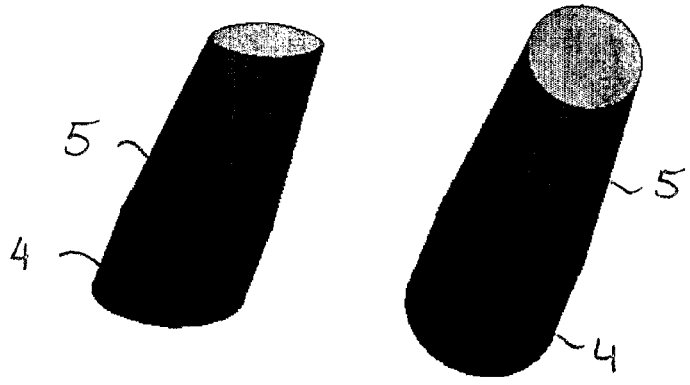
Figure 3:
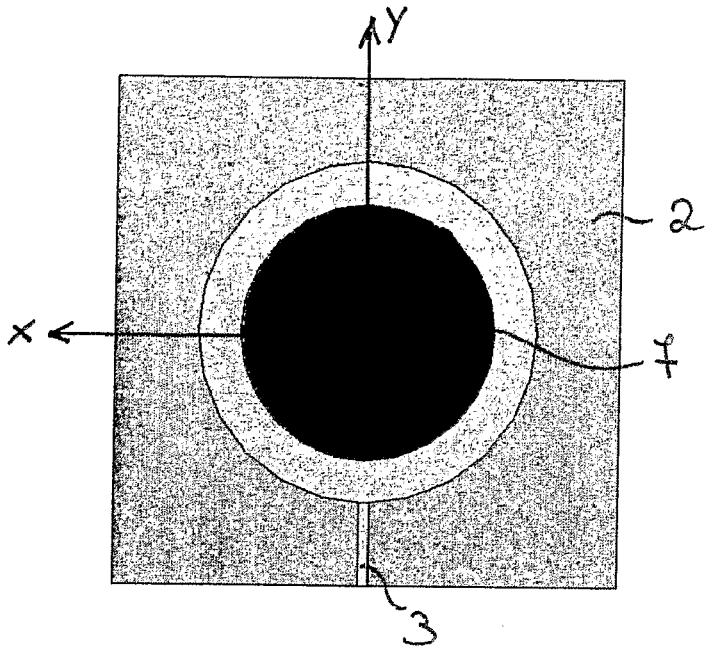
Figure 4:
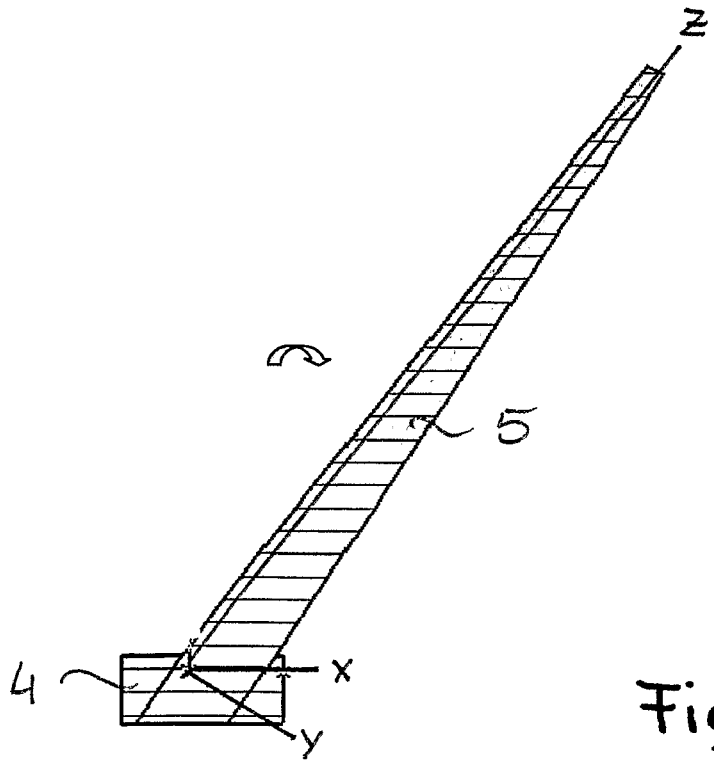
Figure 5A:
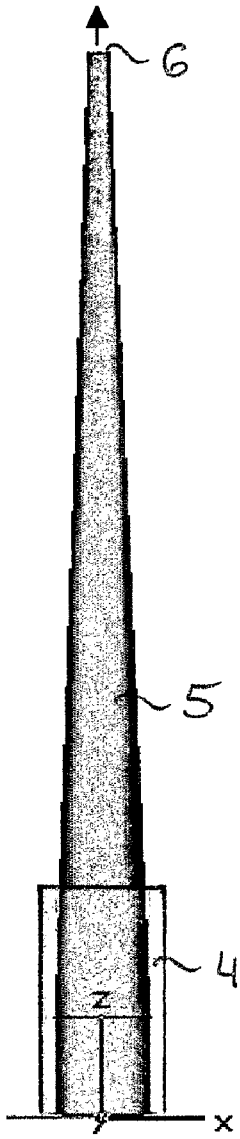
Figure 5B:
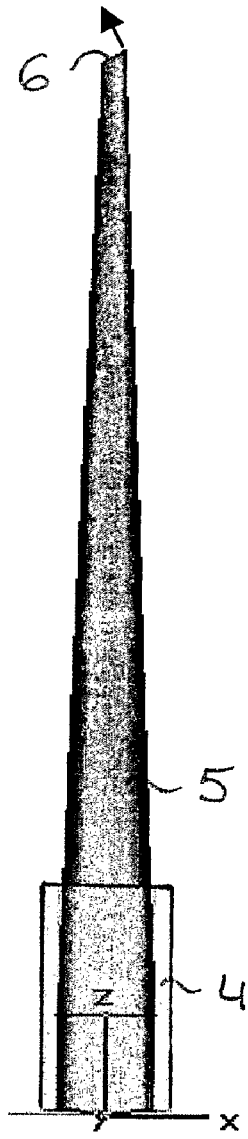
Figures 6A, 6B, 6C:
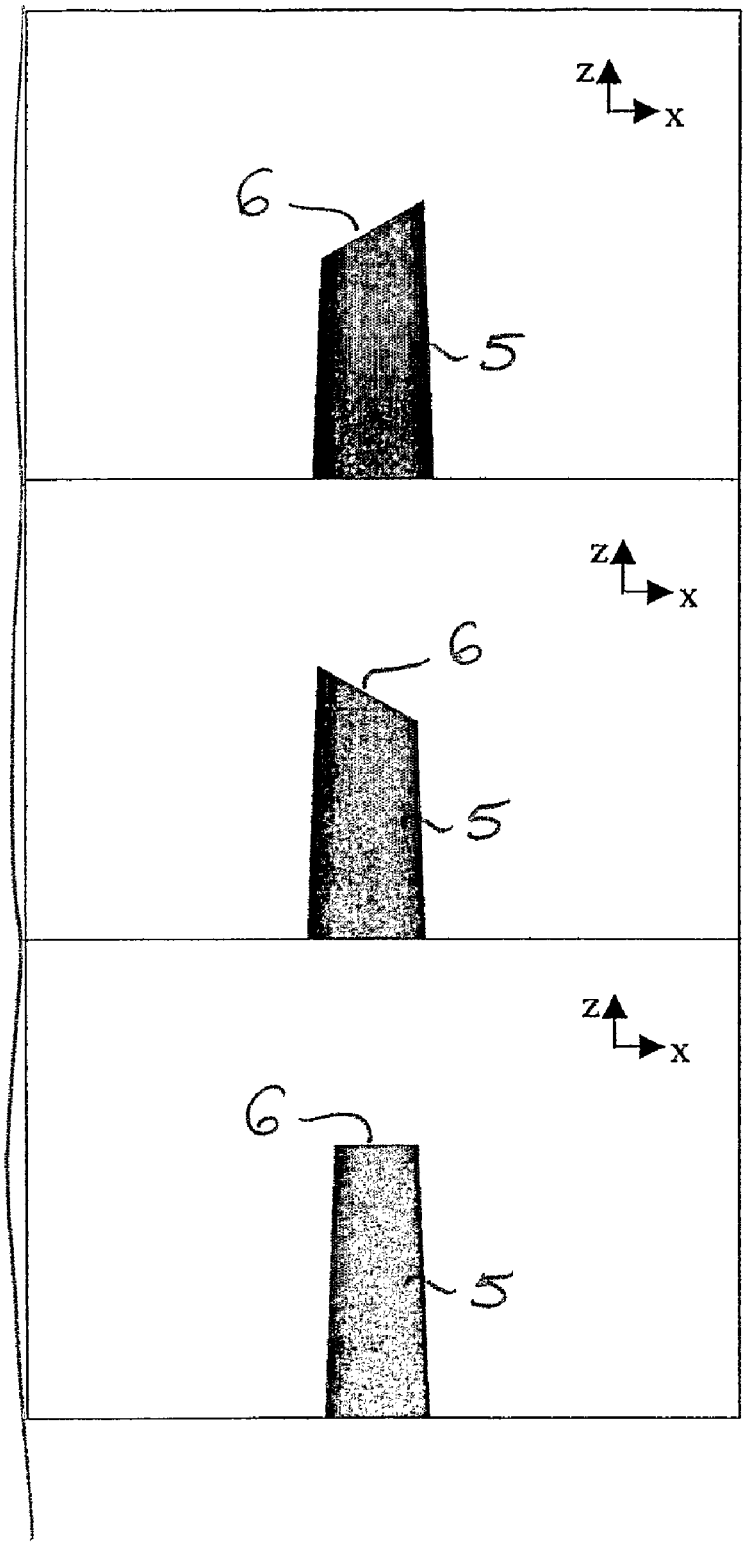

In the following description preferred embodiments of the present invention are explained in more detail in relation to the enclosed drawings, in which FIG. 1 shows a schematic view of a rod antenna according to the present invention, FIG. 2 shows a part of a rod antenna according to the present invention, FIG. 3 shows a patch and a feeding line of a rod antenna according to the present invention, FIG. 4 shows a tilted rod antenna according to the present invention, FIGS. 5*a* and 5*b* show a first and a second embodiment of the rod antenna according to the present invention, and FIGS. 6*a* to 6*c* show parts of different embodiments of the rod antenna according to the present invention.

In the following, a rod antenna 1 according to the present invention is described. It is to be noted that the present antenna also comprises further features necessary for the functionality of an antenna, e.g. a transceiver, a power supply or the like, which are not explained in the following and not shown in the figures for the sake of clarity.

FIG. 1 shows a schematic view of a rod antenna 1 according to the present invention. The antenna 1 comprises a two-dimensional patch 2 for radiating and/or receiving an electromagnetic wave. The patch 2 extends along a plane defined by two coordinate axes being orthogonal to each other, whereby in FIG. 1 the two coordinate axes are denoted by x and y. A feeding line 3 is coupled to the patch 2 for transferring signal energy to and/or from the patch 2. The antenna 1 further comprises a dielectric rod 5 for radiating and/or receiving said electromagnetic wave radiated and/or received by the two-dimensional patch 2. The rod 5 is hereby extending longitudinally from the patch 2 in direction of a third coordinate axis, whereby the third coordinate axis is outside of the plane defined by the first two coordinate axes. In FIG. 1 the third coordinate axis is denoted by z.

A metal holder 4 is coupled to the patch 2 and to the rod 5 for transferring said electromagnetic wave between the patch 2 and the rod. The metal holder 4 is coupled to the patch 2 and encompasses the rod 5 partly. The metal holder 4 works as a waveguide and transfers the electromagnetic wave between the three-dimensional rod 5 and the two-dimensional patch 2. In order to achieve a high gain and small sidelobe the height of the metal holder should be equal to the wavelength of the electromagnetic wave or equal to a half of the wavelength of the electromagnetic wave.

The patch 2 hereby serves as a feeding circuit for the rod 5 of the rod antenna 6. With the patch 2 the circuit matching can be controlled.

With the rod antenna 1 according to the present invention the feeding is not limited to the three-dimensional waveguide feeding and any type of feeding can be used. This enables the implementation of the rod antenna into different devices and the antenna 1 can be easily adapted to the requirements of different applications.

FIG. 2 shows the metal holder 4 and the rod 5 of the antenna 1 according to the present invention. The metal holder 4 is used to align the position of the rod 5 and to control gain and sidelobe performance. The rod 5 may have an oval, elliptical, circular, rectangular or any other cross-section. Further, the cross-section of the rod 5 may be constant in size and shape over the whole length of the rod 5 or the rod 5 may be tapering towards one end. In a preferred embodiment of the present invention the rod 5 has the form of a cylinder, cone or an elliptic cone.

FIG. 3 shows an embodiment of the two-dimensional patch 2 according to the present invention. For the patch 2 any type of two-dimensional radiating element can be used. As shown in FIG. 3, the patch 2 comprises a feeding line 3 and a radiating element 7. Hereby, it is possible to implement the patch 2 as a microstrip line having a conducting stripe on a dielectric substrate over a metallic ground plate. Further use of slots or any other types of radiating elements are possible for the two-dimensional patch 2.

FIG. 4 shows a second embodiment of the present invention. The rod 5 of the antenna 1 is extending into a direction of a third coordinate axis z. Hereby, the coordinate axis z is outside of the plane defined by the first two coordinate axes x and y. Further, outside said plane the third coordinate axis z may have any direction. Therefore as shown in FIG. 4 the rod 5 can have a direction orthogonal to the plane defined by the axes x and y or maybe tilted away from the orthogonal direction. Thereby, the radiation direction of the antenna 1 can be controlled by changing the tilt angle of the rod antenna 1.

In a further embodiment the rod antenna 1 can be used for an antenna array for covering a wide angle of the hemisphere. Herefore, at least two groups of rod antennas 1 are implemented in the antenna array. Each group consists of at least one rod antenna 1 according to the present invention. Further, each group has a beaming direction different from the beaming direction of the other groups. Hereby, the beaming direction is achieved by changing the tilted angle of the rod 5 of the rod antenna 1. With a control circuit then it is possible to change between the different groups for radiating and/or receiving the electromagnetic wave, thereby changing the actual beaming direction in order to cover a wide angle of the hemisphere.

It is to be noted, that the antenna 1 may also comprise a rod 5 without top plane 6.

FIG. 5*a* shows an embodiment of the rod antenna 1 according to the present invention for linear polarised electromagnetic waves and FIG. 5*b* shows an embodiment of the rod antenna 1 according to the present invention for a circular polarised electromagnetic wave. The rod 5 of the rod antenna 1 hereby comprises a top plane 6. Depending on the orientation of the top plane 6 the rod antenna 1 can be used for linear or circular polarisation. In case the top plane 6 is symmetric with respect to the third coordinate axis z as shown in FIG. 5*b*, then the antenna can be used for linear polarisation. In case the top plane 6 is asymmetric with respect to the third coordinate axis z as shown in FIG. 5*b*, then the antenna can be used for circular polarisation.

As shown in detail in FIGS. 6*a* to 6*c* depending on the normalised direction of the top plane 6 the rod antenna 1 can be used for different types of polarisation. When assuming that the feeding line 3 is pointing into the −y-direction, then FIG. 6*a* shows a rod 5 for a right hand circular polarised electromagnetic wave. According to FIG. 6*a* the normalised direction of the top plane is at −x and +z direction. For adapting the rod 5 to a left hand circular polarised electromagnetic wave as shown in FIG. 6*b* the normalised direction of the top plane 6 is pointing into +x and +z direction. In order to adapt the rod 5 to a linear polarised electromagnetic wave as shown in FIG. 6*c* the normalised direction of the top plane 6 is pointing into direction of the z-axis.

It is to be noted, that the direction of the feeding line 3 is not limited to the direction of one of the first two coordinate axes but may have any other direction, e.g. the feeding line may be orthogonal to the first two coordinate axes.

The present antenna can be implemented in small consumer products, such as mobile terminals for wireless communication or the like.

The invention claimed is:

1. An antenna array including a first antenna group and a second antenna group, each antenna group including a rod antenna comprising:

a two-dimensional patch for radiating and/or receiving an electromagnetic wave, said patch extending along a plane defined by two coordinate axes orthogonal to each other;

a feeding line coupled to the patch for transferring signal energy to and/or from the patch;

a dielectric rod for radiating and/or receiving said electromagnetic wave, said rod extending longitudinally from the patch in a direction of a third coordinate axis which is outside of the plane defined by the first two coordinate axes, and said rod being tilted away from an orthogonal direction which is orthogonal to said plane; and a metal holder coupled to the patch and to the rod for transferring said electromagnetic wave between the patch and the rod, wherein said rods of said first and second groups are tilted away from said orthogonal direction in different directions so that said rod of said first group has a different beaming direction than said rod of said second group, and said first and second groups are configured to be alternatively selected so as to change a beaming direction of said antenna array.

2. The antenna array according to claim 1, wherein the feeding line is extending along one of the first two coordinate axes or is orthogonal to the first two coordinate axes.

3. The antenna array according to claim 1, wherein the length of the metal holder is equal to the wavelength of the electromagnetic wave.

4. The antenna array according to claim 1, wherein the length of the metal holder is equal to a half of the wavelength of the electromagnetic wave.

5. The antenna array according to claim 1, wherein the rod has an oval, elliptical, circular, or rectangular cross section.

6. The antenna array according to claim 1, wherein the rod has a cross section constant in size and shape over the whole length of the rod.

7. The antenna array according to claim 1, wherein the rod tapers toward one end.

8. The antenna array according to claim 1, wherein the rod has a top plane.

9. The antenna array according to claim 8, wherein the normalized direction of the top plane extends in the direction of the third coordinate axis.

10. The antenna array according to claim 8, wherein the normalized direction of the top plane extends into a direction different from the direction of third coordinate axis.

11. A mobile terminal comprising an antenna array including a first antenna group and a second antenna group, each antenna group including a rod antenna comprising:

a two-dimensional patch for radiating and/or receiving an electromagnetic wave, said patch extending along a plane defined by two coordinate axes orthogonal to each other;

a feeding line coupled to the patch for transferring signal energy to and/or from the patch;

a dielectric rod for radiating and/or receiving said electromagnetic wave, said rod extending longitudinally from the patch in a direction of a third coordinate axis which is outside of the plane defined by the first two coordinate axes, and said rod being tilted away from an orthogonal direction which is orthogonal to said plane; and a metal holder coupled to the patch and to the rod for transferring said electromagnetic wave between the patch and the rod, wherein said rods of said first and second groups are tilted away from said orthogonal direction in different directions so that said rod of said first group has a different beaming direction than said rod of said second group, and said first and second groups are configured to be alternatively selected so as to change a beaming direction of said antenna array.

* * * * *